US009617739B2

(12) United States Patent
Krause

(10) Patent No.: US 9,617,739 B2
(45) **Date of Patent: *Apr. 11, 2017**

(54) POLYMER-BASED BRACKET SYSTEM FOR METAL PANELS

(71) Applicant: G Matt Krause, Allegan, MI (US)

(72) Inventor: G Matt Krause, Allegan, MI (US)

(73) Assignee: Advanced Architectural Products, LLC, Allegan, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/481,848

(22) Filed: Sep. 9, 2014

(65) Prior Publication Data

US 2015/0121787 A1 May 7, 2015

Related U.S. Application Data

(63) Continuation of application No. 12/984,051, filed on Jan. 4, 2011, now Pat. No. 8,826,620.

(51) Int. Cl.

| | |
|---|---|
| ***E04F 13/08*** | (2006.01) |
| ***E04F 13/12*** | (2006.01) |
| ***E04B 1/41*** | (2006.01) |
| ***E04B 1/76*** | (2006.01) |
| ***E04F 13/00*** | (2006.01) |
| ***E04F 13/22*** | (2006.01) |
| *E04B 1/38* | (2006.01) |

(52) U.S. Cl.

CPC ..... *E04F 13/0875* (2013.01); *E04B 1/40* (2013.01); *E04B 1/7645* (2013.01); *E04B 1/7654* (2013.01); *E04F 13/007* (2013.01); *E04F 13/0817* (2013.01); *E04F 13/12* (2013.01); *E04F 13/22* (2013.01); *E04B 2001/405* (2013.01); *E04B 2001/7679* (2013.01)

(58) Field of Classification Search

CPC ..... E04F 13/0875; E04F 13/007; E04F 13/12; E04B 1/7654; E04B 2001/405

USPC ..... 52/235, 506.05–506.09, 508, 302.3, 52/483.1, 490.1, 490.2, 783.11, 783.14, 52/783.17, 783.18

See application file for complete search history.

(56) References Cited

U.S. PATENT DOCUMENTS 4,483,122 A * 11/1984 Crandell ..... E04F 13/0889 52/235
4,920,719 A * 5/1990 Shaub ..... E04B 9/241 52/506.08
5,444,945 A * 8/1995 Goodwin ..... E04F 13/081 292/199

(Continued)

*Primary Examiner* — Joshua J Michener
*Assistant Examiner* — Alp Akbasli
(74) *Attorney, Agent, or Firm* — The Watson IP Group, PLC; Jovan N. Jovanovic; Vladan M. Vasiljevic

(57) ABSTRACT

A system for supporting exterior panels on a substrate of a building structure. The system has a plurality of polymeric bracket members, and each of the bracket members have at least one anchor section, at least one web section and at least one support section. The polymeric bracket members provide a thermal break from the exterior panel to the substrate of the building structure. A plurality of exterior cladding units are held in place by the bracket members. A plurality of vents are disposed between the panels and the exterior panels, and a plurality of vents are also disposed between the panels and the substrate, thereby forming a ventilation system.

14 Claims, 12 Drawing Sheets

(56) References Cited

U.S. PATENT DOCUMENTS 5,544,461 A * 8/1996 Sommerstein ..... E04F 13/0807 52/235
5,860,257 A * 1/1999 Gerhaher ..... E04F 10/10 52/235
6,029,418 A * 2/2000 Wright ..... B32B 7/12 403/210
6,055,787 A * 5/2000 Gerhaher ..... E04F 13/0826 52/506.06
6,098,364 A * 8/2000 Liu ..... E04F 13/0855 52/235
6,170,214 B1 * 1/2001 Treister ..... E04F 13/0808 52/235
6,205,731 B1 * 3/2001 Gerhaher ..... B28B 3/26 52/235
6,289,646 B1 * 9/2001 Watanabe ..... E04F 13/083 52/235
6,425,218 B1 * 7/2002 Doyon ..... E04F 13/081 403/295
6,945,414 B1 * 9/2005 Stevens ..... A47F 5/0846 211/183
7,017,317 B2 * 3/2006 Capozzo ..... E04B 9/0478 52/127.12
7,043,884 B2 * 5/2006 Moreno ..... E04F 13/0808 52/235
7,351,003 B1 * 4/2008 Fenimore ..... E01F 15/085 40/565
7,849,651 B2 * 12/2010 Fujito ..... E04F 13/0803 248/216.1
7,891,146 B1 * 2/2011 Sherwin ..... E06B 9/02 52/202
8,127,507 B1 * 3/2012 Bilge ..... E04F 13/0814 52/235
8,186,119 B1 * 5/2012 Huff ..... F24F 3/0442 52/302.3
8,464,487 B2 * 6/2013 Kenda ..... E04F 13/0812 52/474
8,826,620 B2 * 9/2014 Krause ..... E04F 13/0817 52/235
8,833,025 B2 * 9/2014 Krause ..... E04F 13/0828 52/235
D756,255 S * 5/2016 Hinebaugh ..... E04B 1/003 D10/113.3
2001/0011443 A1 * 8/2001 Watanabe ..... E04F 13/0816 52/506.05
2005/0011154 A1 * 1/2005 Kim ..... E04D 3/362 52/506.06
2007/0220821 A1 * 9/2007 Omiya ..... E04F 13/0862 52/391
2008/0010922 A1 * 1/2008 Wagner ..... E04F 13/0812 52/235
2008/0104918 A1 * 5/2008 Gleeson ..... E04B 1/74 52/489.1
2010/0192495 A1 * 8/2010 Huff ..... E04F 13/14 52/302.1
2010/0307094 A1 * 12/2010 Spyrou ..... E04B 1/003 52/489.1

* cited by examiner

POLYMER-BASED BRACKET SYSTEM FOR METAL PANELS

BACKGROUND OF THE INVENTION

In the past, in order to provide a highly thermally efficient (metal) wall or (metal) roof assembly for a building enclosure, it has been necessary for metal materials, typically an exterior and interior metal skin, to be bonded to either side of an insulated panel core inside a factory thereby creating a foam panel. These metal skins are typically profiled and have offsets in them to prevent the exterior metal skin from contacting the interior metal skin. This is done in an effort to prevent metal to metal contact thereby reducing thermal conductivity from the outside of the building. Heat travels in the path of least resistance such that heat can invade a system and affect an interior atmosphere through relatively finite pathways such as fasteners and the like that have metal to metal contact with exterior conditions. Most applications of metal roof and wall assemblies retain at least some form of metal to metal contact through metal anchors, fasteners, or sill, transition, and window trim. Products of this type are subject to shorter warrantees and life cycles due to the fact that the product is glued or otherwise bonded and is subject to damage and shortened life spans from thermal cycling which causes varying rates of contraction and expansion of the different materials and therefore wears significantly on any given system. Furthermore, these systems often require like materials to be in contact with each other which can lead to reactions such as oxidation which can corrode these materials over time. A metal wall, roof or deck system that creates a thermal break in the heat conductivity path thereby effectively eliminating or greatly reducing thermal bridging from exterior conditions to interior conditions that keeps like materials separate is desired.

BRIEF SUMMARY OF THE INVENTION

One aspect of the present invention is a system for supporting exterior cladding units on a substrate of a structure. The system includes a polymeric bracket system made up of a plurality of polymeric bracket members, and each of the bracket members have at least one anchor section, at least one web section and at least one support section. The anchor section(s) attaches the bracket member to the substrate, the web section(s) connects the anchor section(s) to the support section(s), and the support section(s) attaches to the exterior cladding unit. The polymeric bracket members provide a thermal break from the exterior cladding unit to the substrate of the building structure. In the polymeric bracket system, each of the polymeric bracket members are mounted to the building structure to form rows thereby forming channels between the exterior cladding units and the substrate when the exterior cladding units are mounted. A ventilation system having a plurality of vents is formed by the mounting of the exterior cladding units to the polymeric bracket system.

Another aspect of the present invention is a polymeric bracket member having at least one anchor section, at least one support section, and at least one web section. The anchor section has at least one channel. The support section also has at least one channel. The channel(s) of the support section is adapted to retain an insert.

Yet another aspect of the present invention is a bracketing system having a grooved polymeric stud. The system also includes first and second clips operably coupled to the stud. The first and second clips have attachment surfaces and comprise channels.

These and other features, advantages, and objects of the present invention will be further understood and appreciated by those skilled in the art by reference to the following specification, claims, and appended drawings.

DETAILED DESCRIPTION

Figure 1:
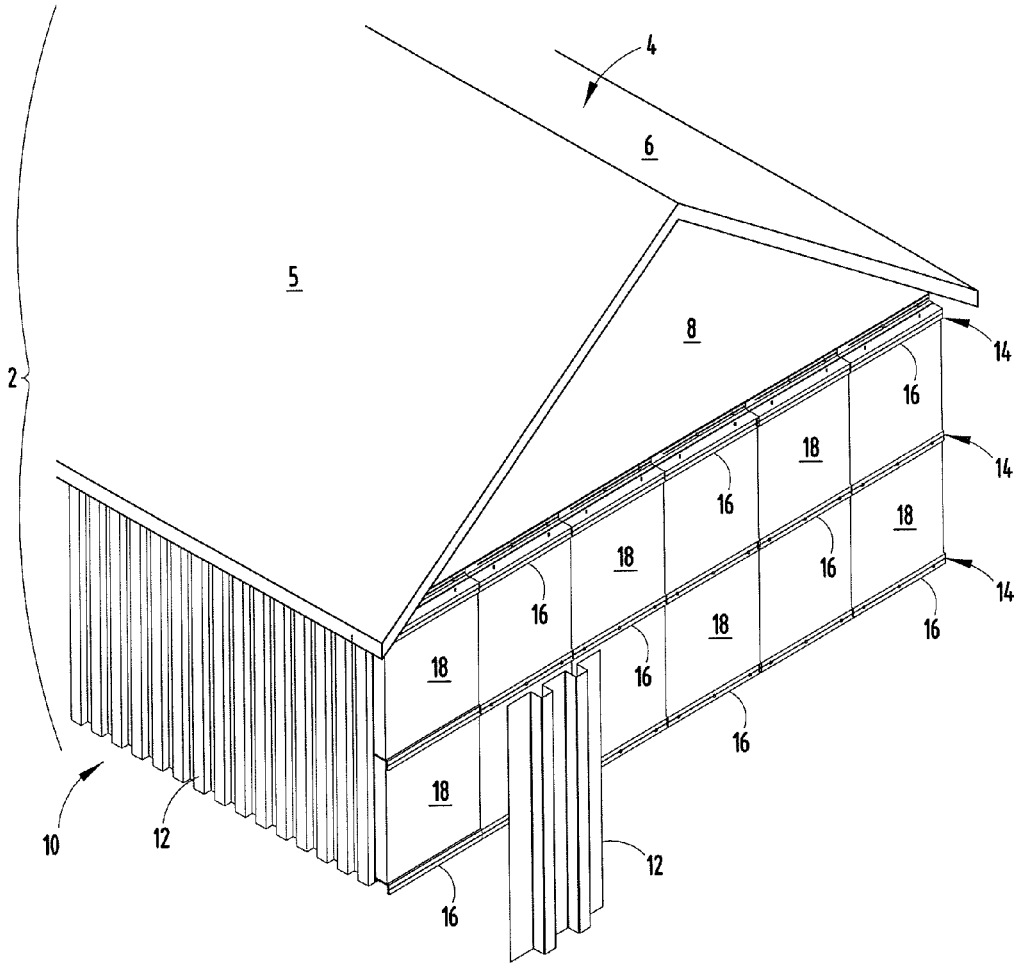
FIG. 1 is a perspective view of a building having a wall system embodying the present invention.

For the purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations, except where expressly specified to the contrary. It is also to be understood that the specific devices and processes illustrated in the attached drawings, and described in following specification, are simply exemplary embodiments. Hence, specific dimensions and other physical characteristics relating to the embodiments disclosed herein are not to be construed as limiting, unless expressly stated otherwise.

The reference numeral 2 (FIG. 1) generally designates one embodiment of the present invention wherein a building structure includes a roof 4 with sides 5, 6, a front wall 8, and a side wall 10. The side wall or building substrate 10 is covered by exterior cladding units 12 which, in this embodiment, are depicted as ribbed panels made of a substrate generally known in the industry for use in an exterior surface of a building structure 2 such as steel, aluminum, zinc, and other such substrates. The front wall 8 is shown with a polymeric bracket system having rows 14 made up of polymeric bracket members or girts 16 which exhibit low thermal conductivity and are used to connect the exterior cladding units 12 to the building structure 2. Disposed between rows 14, are channels that are formed between the building substrate 10 and the exterior cladding units 12 when the exterior cladding units 12 are mounted to the bracket members 16. As shown in the embodiment in FIG. 1, insulating material 18 is housed in the channels disposed between the rows 14 of bracket members 16, wherein the insulating material 18, as shown in this embodiment, are modular insulation panels that serve to insulate the building structure 2 in assembly. The insulating material 18 can also be fire retardant panels, sound dampening panels or any other type of insulating material or panel known in the art for providing an interior or exterior wall with a quality for which the panel is known. Other such insulating materials or panels include materials having additives like insecticides, fungicides or colorants for example. Though many types of insulating materials are known in the art, for the purposes of the description below, insulating materials 18, as depicted in the accompanying figures, are exemplified as panels designed to insulate the building structure. Other insulating materials suitable for use with the present invention include, foam, fiberglass insulation, rigid insulation, semi rigid insulation, blanket insulation, loose fill insulation, spray foam in either fiberglass, rock wool, cellulose based, polystyrene, polyisocyanurate, polyurethane or other polymeric insulation formulation. Further, for the purposes of the description below, the exterior cladding units 12, as depicted in the figures, are exemplified as modular exterior panels made of a metal substrate. The present invention is for use in many different applications such as wall systems, roof systems, decking systems and the like. For purposes of this application, an embodiment of the present invention will be exemplified as a metal wall panel system for description purposes, but is no way designed to limit the scope of the invention to an exterior wall panel system.

Figure 2:
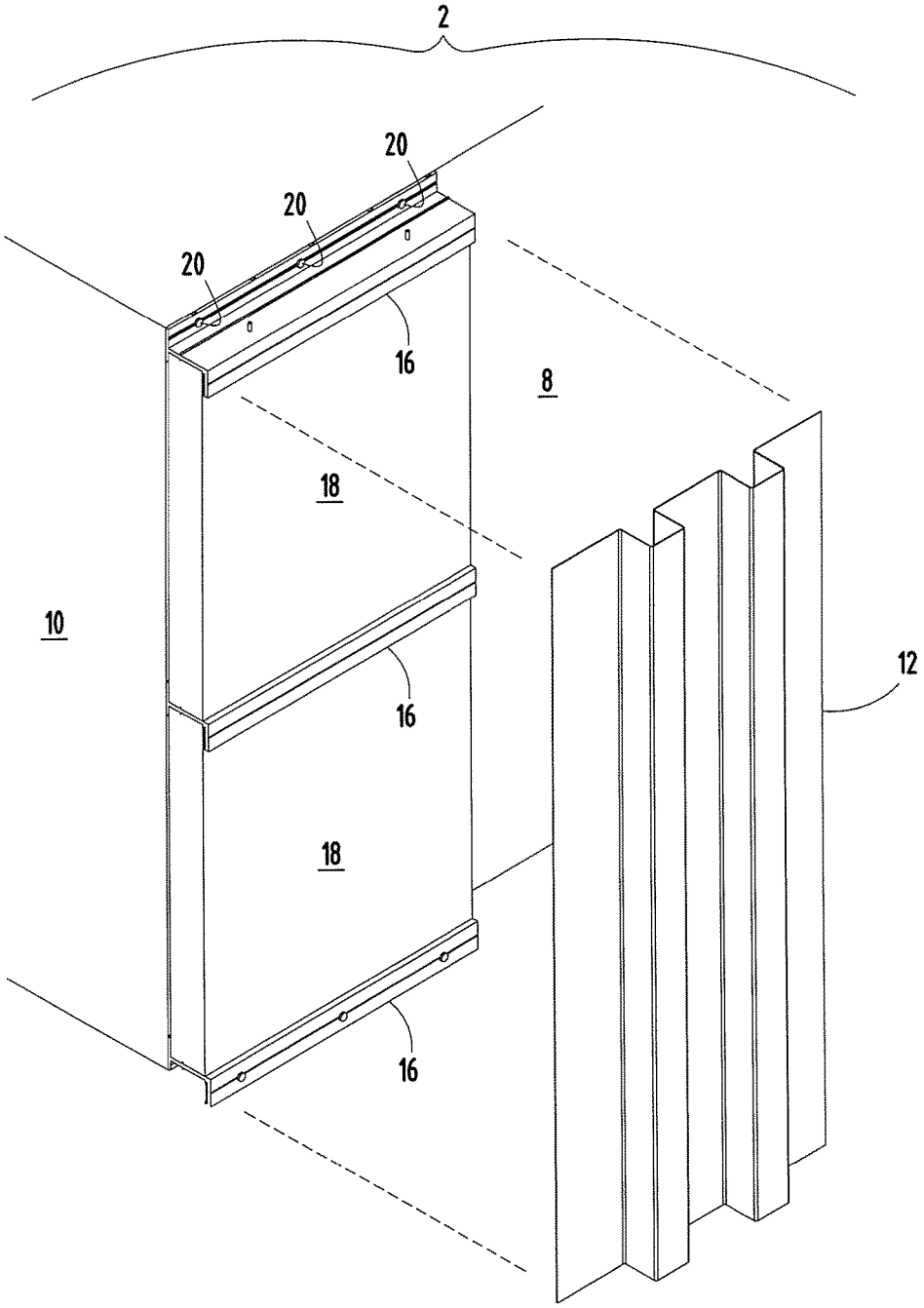
FIG. 2 is a perspective view of a bracket system and exterior panel.
Figure 2A:
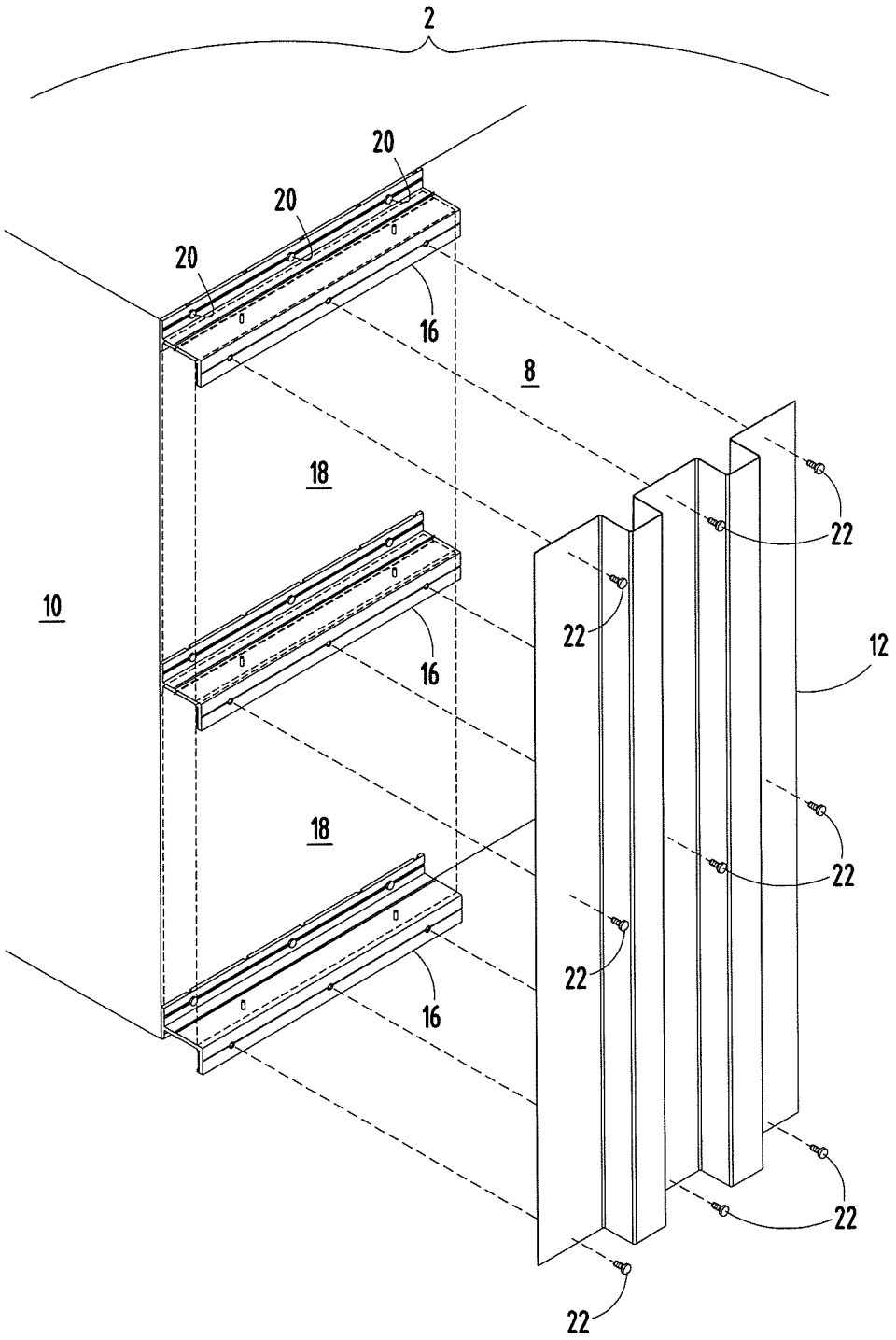
FIG. 2A is a perspective view of a bracket system and exterior panel.

As shown in FIG. 2, fasteners 20 as known in the art are used to connect bracket members 16 to a building substrate such as the front wall 8 of the building structure 2. As shown in FIG. 2A, fasteners 22 are used to connect the panels 12 to the bracket member 16 as indicated by the dotted lines in assembly thereby rigidly connecting the panels 12 to the substrate or front wall 8 of the building structure 2. As shown in FIG. 2, insulating panels 18 are disposed between the bracket members 16 in the channels formed between rows 14.

Figure 3:
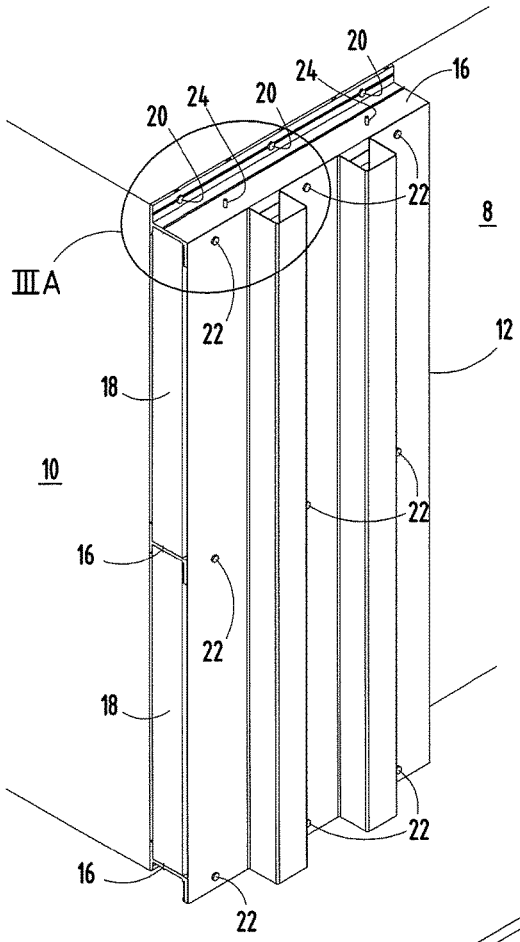
FIG. 3 is a perspective view of a bracket system and exterior panel attached to a building substrate.
Figure 3A:
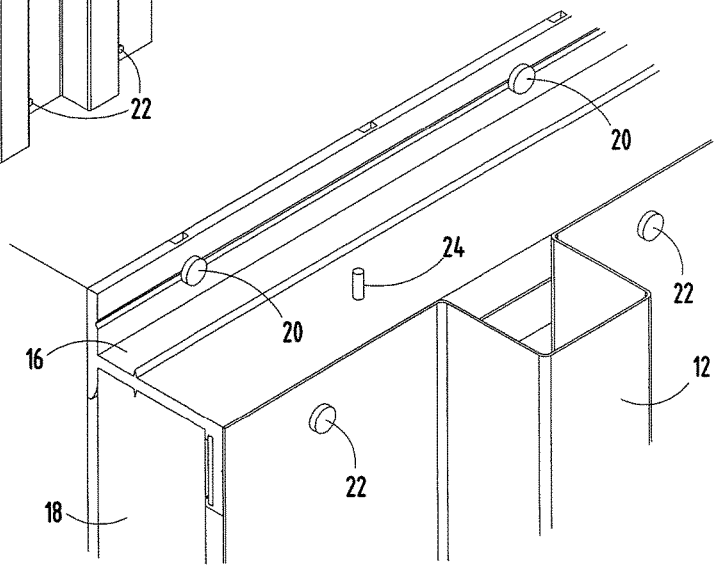
FIG. 3A is a fragmentary perspective view of a bracket system and exterior panel attached to a building substrate.

As shown in FIG. 3, an exterior panel 12 is secured to the bracket member 16 by fasteners 22 and the bracket member 16 are further coupled to the front wall 8 of the building structure 2 by fasteners 20. As shown in FIG. 3A, the bracket members 16 further comprise retention pins 24, or panel retention pins, in this embodiment, which are used to hold insulation panels 18 in place during assembly.

Figure 4:
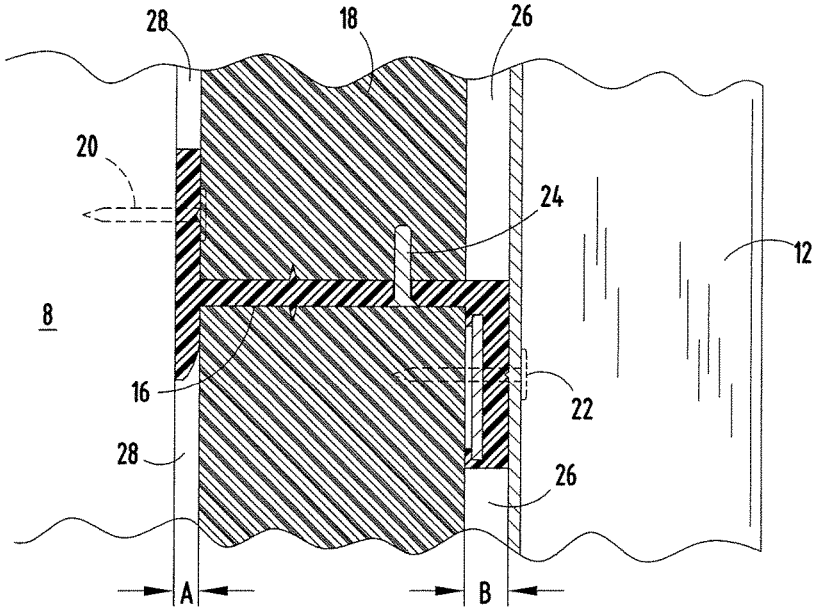
FIG. 4 is a fragmentary elevational view of a bracket member and exterior panel attached to a substrate.

As shown in FIG. 4, the bracket member 16 is shown operably coupled to a substrate 8 and operably coupled to an exterior panel 12 in a lateral relationship, and has insulation panels 18 vertically disposed on either side of the bracket member 16. In this configuration, the bracket member 16, having low thermal conductivity, creates a thermal break in the path of heat conductivity from the exterior panel 12 to the building substrate 8 in such a way that there is no metal to metal contact. As used herein, the term "thermal break" refers to a break in like materials wherein the material disposed between like materials is comprised of a material having low thermal conductivity such as a polymeric material having a high R-value as further described below. R-values are measurements of the thermal resistance of different materials. R-values are well known by those skilled in the art of the construction and insulation industries. Further, in this configuration, there are no like materials in contact with another, nor is there any metal to metal contact creating a pathway for heat to transfer from the exterior to the interior and vice versa.

As shown in FIG. 4, a ventilation system is comprised in part by vents 26 and 28 disposed above and below the bracket member 16 such that vents 26 are formed between the insulation panel 18 and the exterior panel 12 and vents 28 are formed between the insulation panel 18 and the building substrate 8.

Figure 5:
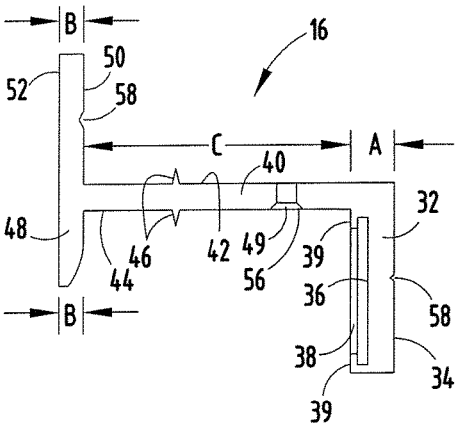
FIG. 5 is a side elevational view of a bracket member.

FIG. 5 generally depicts a side elevational view of a bracket member 16 which, in this embodiment, has a general Z-shaped configuration with a support section 32, adapted to connect to and support an exterior cladding unit. In this embodiment, the support section 32 of the bracket member 16 includes an exterior surface 34 and interior surface 36 wherein the interior surface 36 further comprises a T-shaped channel 38. The support section 32 has a planar thickness "A" which correlates to the size of the vents 26 which are disposed between the insulation panels 18 and the exterior panels 12, as shown in FIG. 4.

As shown in FIG. 5, the bracket member 16 further comprises a web or body section 40 which has a first side 42 and a second side 44 wherein an aperture 49 is disposed on the body section 40 of the bracket member 16 and is configured to house pins 24 which help to hold the insulation panels 18 in place in assembly. The web or body section 40 connects the support section 32 to the anchor section 48 described below. As shown in FIG. 5, the aperture 49 further comprises a beveled side 56 disposed on the second side 44 of the body section 40 of the bracket member 16. It is also contemplated that the beveled section 56 of aperture 49 can be disposed on the first side 42, the second side 44, or both the first and second sides 42, 44 of the body section 40 of the bracket member 16 for positively capturing a pin 24 (not shown) with a beveled head that corresponds to the counter sunk beveled edge or edges of aperture 49. The body portion 40 further comprises retention fins or panel piercing airlock ribs 46 which, in this embodiment help to hold insulation panels 18 in place. It is further contemplated that the insulation panels 18 (not shown) can be manufactured with a channel that corresponds to the fins or ribs 46 of the bracket member 16 to retain the insulation panels 18 in place in assembly. The body section 40 of the bracket member 16 has a length "C" which generally corresponds to the width of the insulation panels 18. The bracket member 16 further comprises an anchor section 48 having an exterior side 50 and an interior side 52 which is used to anchor the bracket member 16 to a substrate 8 with fasteners 20 such as shown in FIG. 4. The anchor section 48 of the bracket member 16 has a planar thickness "B" which corresponds to the width of the vents 28 as shown in FIG. 4 in a similar fashion as vents 26 correspond to planar thickness "A" of the support section 32.

In the embodiment shown in FIG. 5, the bracket member 16 further comprises channels 58 disposed on both the support section 32 and anchor section 48 which are used to guide fasteners 20 and 22 in assembly. In the embodiment shown in FIG. 5, the support section 32 of the bracket member 16 further comprises a T-shaped channel 38 which is adapted to accept an insert (not shown) which is used to help retain fasteners in assembly as described in more detail below.

Figure 5A:
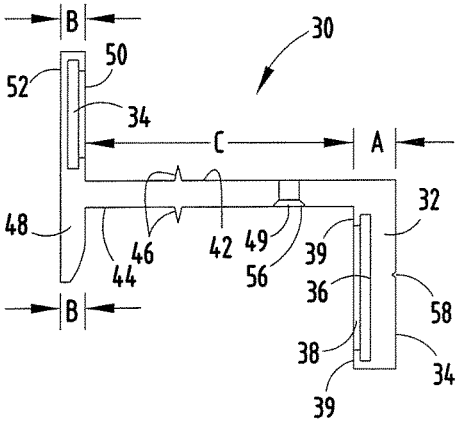
FIG. 5A is a side elevational view of a bracket member.

In the embodiment shown in FIG. 5A, a bracket member 30 generally has similar features as the bracket shown in FIG. 5 with exception of the exterior side 50 of the anchor section 48 having a T-shaped channel 54 for use in accepting an insert (not shown) which is used to help retain fasteners 20 in assembly.

Figure 6:
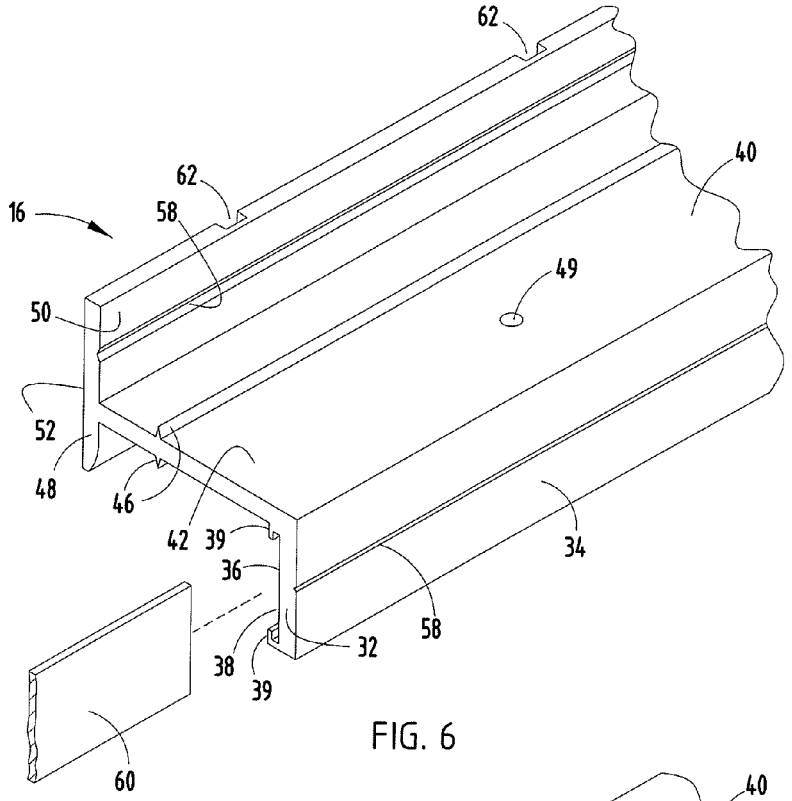
FIG. 6 is a fragmentary perspective view of a bracket member.

As shown in FIG. 6, the bracket member 16 further comprises a slideable, insert 60 which can be inserted into T-shaped channel 38 and moved laterally along T-shaped channel 38 by sliding the insert 60 along the length of the T-shaped channel 38 to facilitate fastener retention when fasteners 22 (not shown) are used to secure exterior panels 12 to the bracket member 16. The insert 60 can be an insert which can be made of a rigid polymer, metal or other like reinforcing material adapted to rigidify the bracket members 16 and retain fasteners in assembly. The insert 60 can also be made from recycled materials such as recycled metal or other like material. The T-shaped channel 38 disposed on the interior surface 36 of support section 32 further comprises channel tabs 39 which positively capture the insert 60 in the T-shaped channel 38 while allowing the insert to slide along the length of the T-shaped channel 38.

Figure 7:
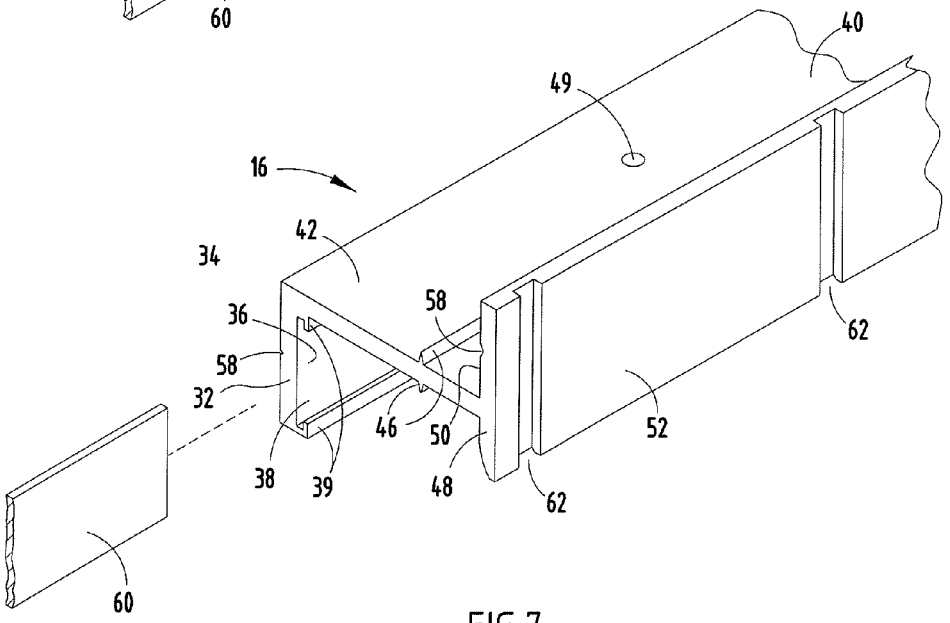
FIG. 7 is a fragmentary perspective view of a bracket member.

In the embodiment shown in FIGS. 6 and 7, the anchor section 48 of the bracket member 16 further comprises channels 62 disposed along the interior side 52 of the anchor section 48 wherein the channels 62 vertically span the length of the interior side 52 of the anchor section 48. The channels 62 make up, in part, the ventilation system of this embodiment by providing a cross ventilation air groove for rear ventilating and rain screening of the bracket and panel system.

The bracket members 16 are developed from an anticorrosive polymeric material that exhibits high insulative qualities or rather, demonstrates high R-value properties such as an R-value in the range of about R1.5 to about R8 per inch. Polymeric materials suitable for the present invention include thermoplastics or thermoset resin materials including for example: acrylonitrile-butadiene-styrene (ABS) copolymers, vinylesters epoxies, phenolic resins, polyvinyl chlorides (PVC), polyesters, polyurethanes, polyphenylsufone resin, polyarylsulfones, polyphthalimide, polyamides, aliphatic polyketones, acrylics, polyxylenes, polypropylenes, polycarbonates, polyphthalamides, polystyrenes, polyphenylsulfones, polyethersulfones, polyfluorocarbons and blends thereof. Other such thermoplastics and thermoplastic resins suitable for the present invention are known in the art which demonstrate high R-values and are thereby heat resistant as well as anticorrosive. Thermoplastics of the present invention are also contemplated using a recyclable polymer or are made of a polymeric material which is partially comprised of a renewable resource such as vegetable oil or the like in its composition when an eco-friendly or "green" bracket member is desired. The polymeric material of the present invention can also be reinforced with a reinforcing fiber as detailed below. Bracket members composed of the materials discussed above form a thermal break between exterior panels and building substrates in an effort to control the temperature within a building structure by reducing or eliminating thermal conductivity from the exterior panel to the building substrate and vice versa. In assembly, the U-value of an exterior wall panel system of the present invention can typically exhibit a U-value from about U1.5 to about U30 depending on the thickness of the overall system, the insulation materials used and the composition of the bracket members.

There are several different types of measurements that relate to a materials ability to insulate, resist, transmit or conduct heat across a material. Particularly, a material's K-value relates to a specific material's thermal conductivity, a material's C-value correlates to the material's thermal conductance, a material's R-value relates to a material's thermal resistance, and a U-value relates to the thermal transmittance of an overall system. In designing a wall, roof or deck bracket and panel system providing adequate insulative properties for a building structure, materials with low K-values and C-values are desired while materials with high R-values are desired. When this set of conditions is met, the overall thermal transmittance, or U-value, of the system is low. Thus, the lower the U-value, the lower the rate heat thermally bridges from one material to another. A building structure having a well insulated system will have a much lower U-value than an uninsulated or poorly insulated system exhibiting high thermal transmittance.

Regarding the R-value of the bracket members of the present invention, a relatively high R-value is desired to ensure adequate insulation of a building structure from outside elements by making a bracket that creates thermal break in a wall panel system. A range of R-values for the polymeric materials used to construct the bracket members described above would be a range of about R1.5 to about R8 per inch in order to create a thermal break that effectively reduces or eliminates thermal bridging. The thermal conductivity, or K-value, is the reciprocal of the material's R-value, such that for a polymeric material exhibiting an R-value of about R1.5 to R8 per inch, the correlating K-value for that material would be from about K0.66 to about K0.125 per inch. Thus, in comparison to present day metal brackets used in other bracket and panel systems made of iron or steel, a polymeric bracket member of the present invention will exhibit a K-value of approximately about K.5 to about K0.125 per inch at a given set of conditions as compared to a bracket made from a material such as iron or steel which would have an approximate K-value as high as K32 to K60 per inch at the same conditions. This is because iron and steel have low R-values and are well known conductors of heat.

The bracket members of the present invention are typically molded members which are formed from the materials noted above and generally used in an molding processes such as injection molding, extrusion molding, pultrusion molding and other such molding techniques known in the art. In order to provide a polymeric bracket having comparable strength to the metal brackets known in the art, a reinforcing fiber may be introduced into the polymeric mix to increase the strength of the polymeric bracket member. For example, glass fibers (fiberglass), carbon fibers, cellulose fibers, nylon fibers, aramid fibers, and other such reinforcing fibers can be introduced into the overall polymeric composition before or during the molding process, thereby resulting in a bracket member which has a sufficiently high R-value to create a thermal break in a metal wall system of a building structure, while also having the requisite strength to adequately support exterior panels of a metal panel wall system on a building substrate.

Figure 8:
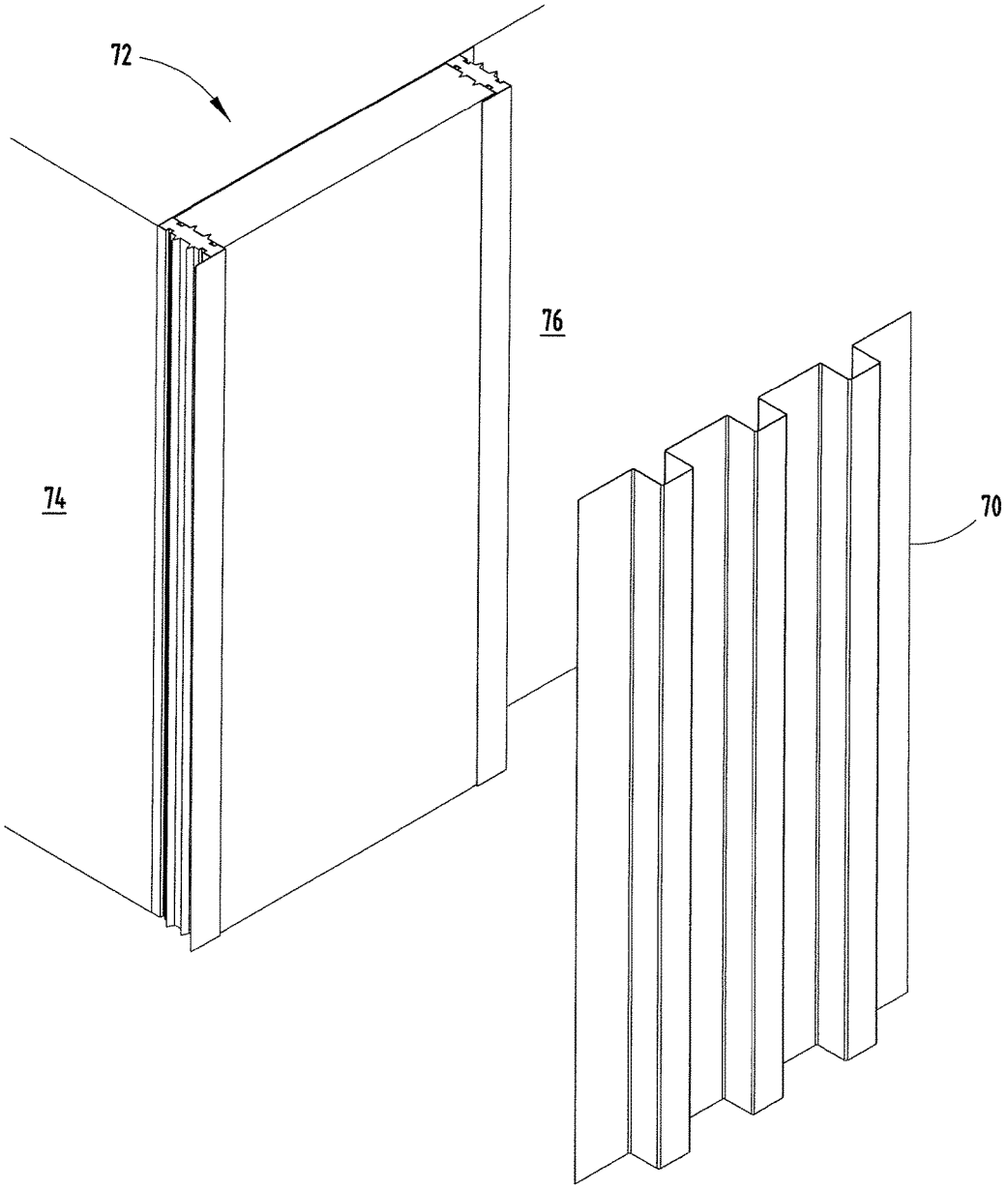
FIG. 8 is a perspective view of a bracket system and exterior panel of another embodiment of the present invention.
Figure 8A:
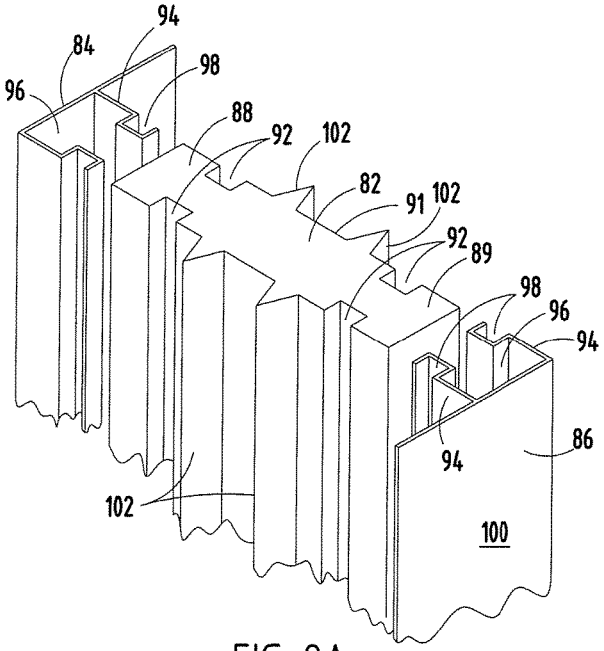
FIG. 8A is a fragmentary perspective view of a bracket system.
Figure 9:
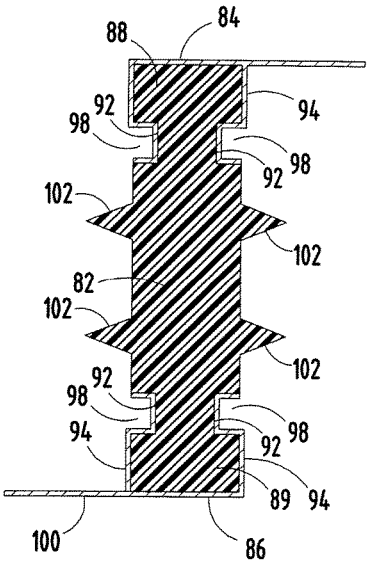
FIG. 9 is a side elevational view of a bracket system.
Figure 10:
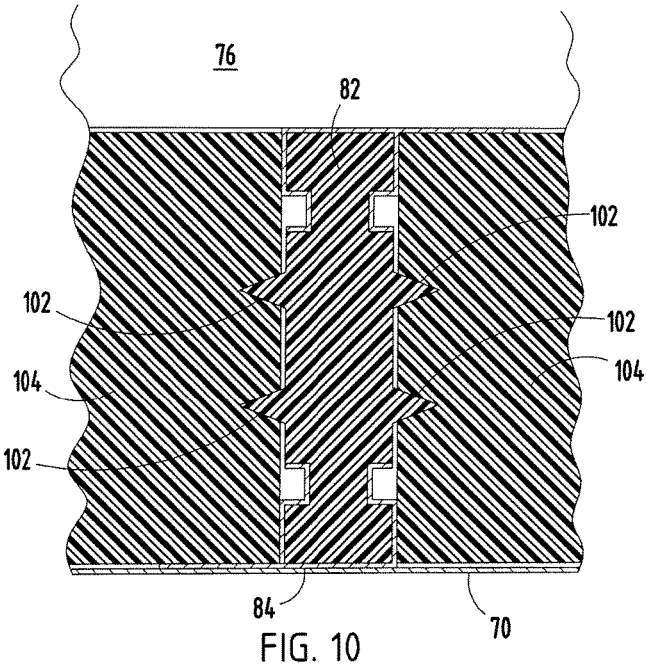
FIG. 10 is a fragmentary elevational view of a bracket system attached to a building substrate and exterior panel.
Figure 11:
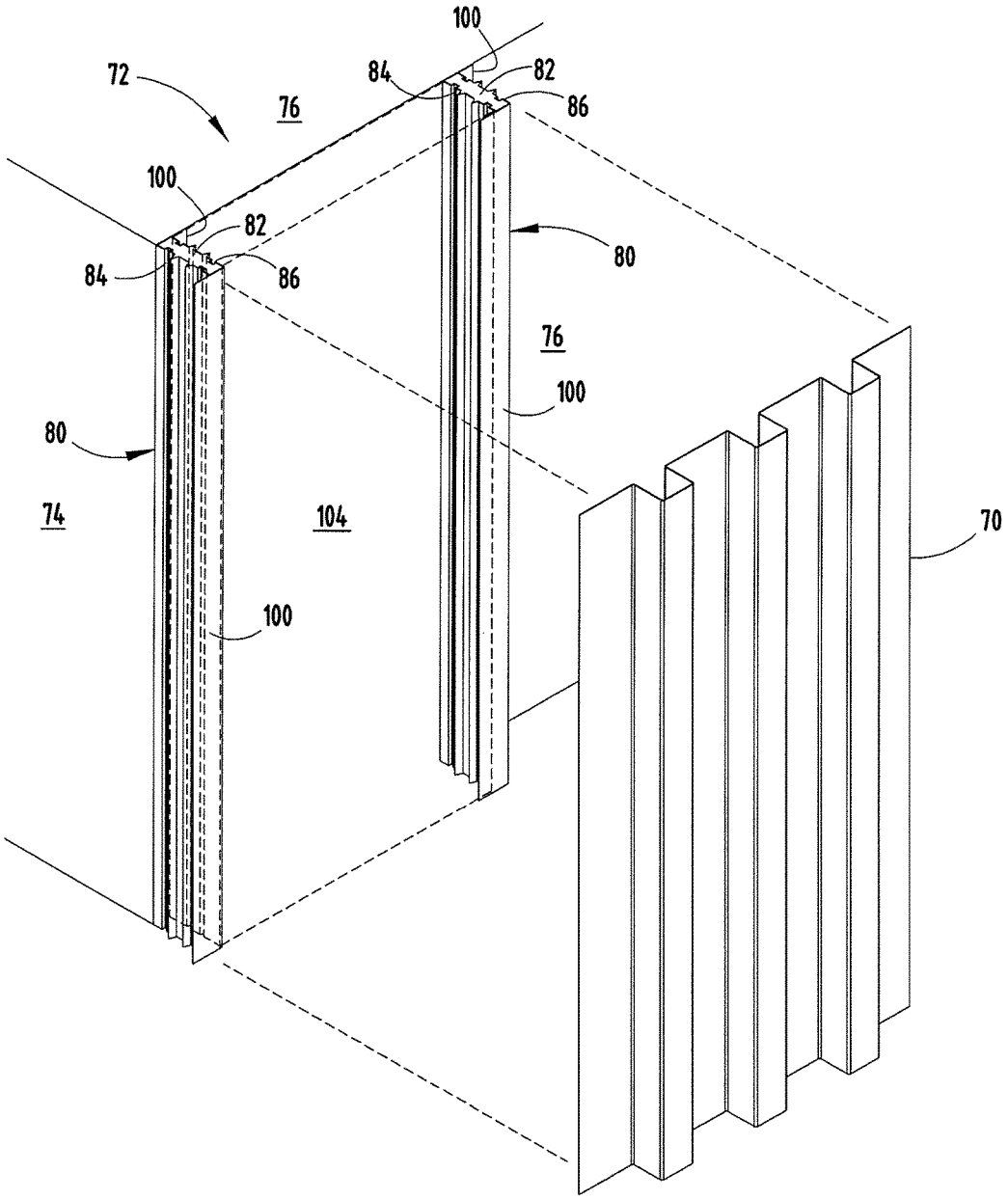
FIG. 11 is a perspective view of a bracket system and exterior panel.

In the embodiment shown in FIG. 8, dotted lines indicate the mounting of an exterior cladding unit 70, shown in FIG. 8 as an exterior panel, to a building structure 72. The building structure has walls 74, 76 which can be any substrate normally found on a building structure such as a sheathed stud wall, a concrete wall, a masonry wall, or a steel roof deck. The exterior panel 70 attaches to the building structure via a bracketing system 80 (FIG. 8A) which comprises a grooved stud 82 generally made of a polymeric material having a significantly high R-value (as described above for bracket member 16) and clips 84, 86 which are generally made of a metallic material. As shown in FIG. 8A, the stud 82 has a first end 88 and a second end 89 which further comprise channels 92 giving the first end 88 and second end 89 a general T-shaped configuration. Channels 92 are U-shaped channels disposed on first and second sides 90 and 91 of the grooved stud 82. Clips 84 and 86 comprise flanges 94 which coordinate to form a T-shaped channel 96 which generally correlates to the T-shaped first and second ends 88 and 89 of the stud 82. The clips 84 and 86 further comprise U-shaped channels 98 which correlate with U-shaped channels 92 of the grooved stud 82. Thus, the configuration of the stud 82 and the clips 84 and 86 coincide such that the clips 86 and 84 can slide on to the ends 88 and 89 of the stud 82 as shown in FIG. 9. The clips 84 and 86 further comprise attachment surfaces 100 which are used to attach the clips to either a building substrate or an exterior panel. The stud 82 further comprises retention fins, or in this embodiment, panel retention fins 102 used to keep insulating materials, such as panels 104, in place in assembly as shown in FIG. 10. The panel retention fins 102 are disposed on both first and second sides 90, 91 of the stud 82. As shown in FIG. 11, a plurality of bracketing systems 80 are attached to a building structure 72 on the building structures exterior walls 74 or 76. The bracketing systems 80 are attached to the wall 76 as shown in FIG. 11, in a vertical stud-like fashion. In this fashion, clip 84 is attached to the building structure substrate or wall 76 at the attachment surface 100 of the clip 84. The stud 82 is then disposed between clip 84 and clip 86 and the clips are attached to stud 82 in the manner shown in FIG. 9 such that attachment surface 100 of clip 86 is exposed for the attaching of an exterior panel 70.

Figure 12:
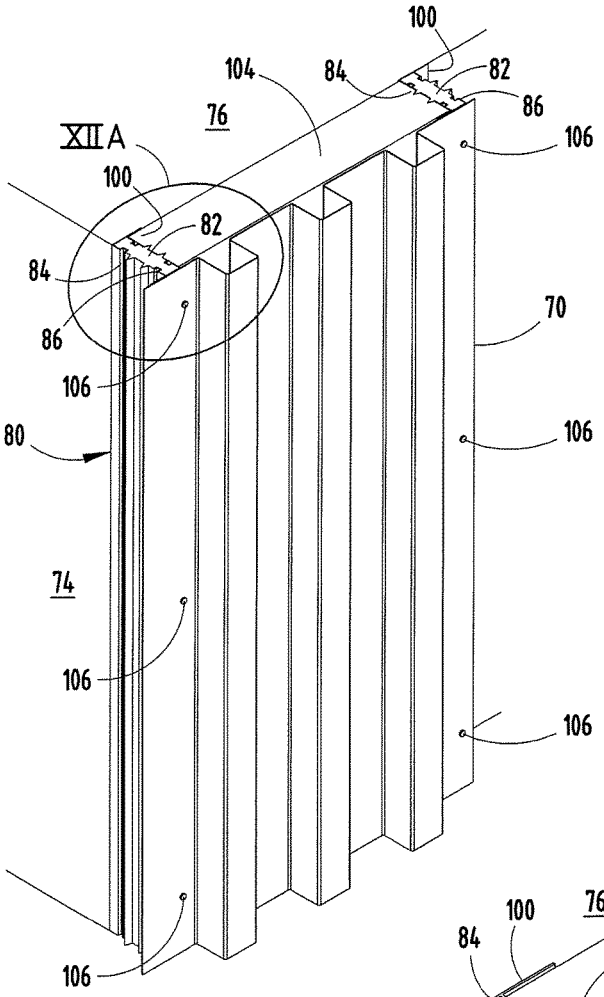
FIG. 12 is a perspective view of a bracket system attached to a building substrate and exterior panel.

As shown in FIG. 12, the exterior panel 70 is attached to a plurality of bracketing systems 80 by fasteners 106. Between bracketing systems 80, a panel 104 is disposed wherein the panel 104 is made of a material similar to the panels 12 as described above. In this configuration, the stud 82 creates a thermal break between the exterior panel 70 and the building substrate 76. Further, in this configuration, there are no like materials in contact with another, nor is there any metal to metal contact creating a pathway for heat to transfer from the exterior to the interior and vice versa.

Figure 12A:
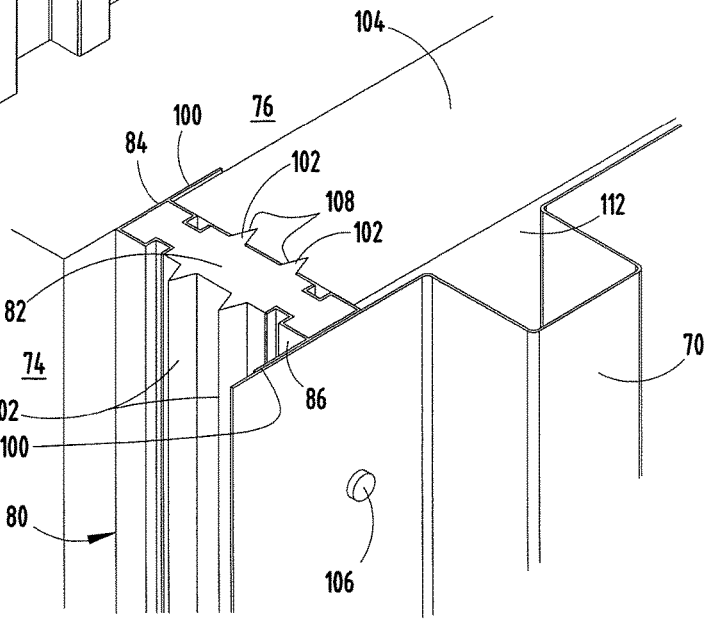
FIG. 12A is a fragmentary perspective view of a bracket system attached to a building substrate and exterior panel.

As shown in FIG. 12A, a bracketing system 80 is shown attached to a substrate 76 via a clip 84 through fasteners (not shown) and further attached to an exterior panel 70 via clip 86 using fasteners 106. The panel retention fins 102 are shown fitting into grooved channels 108 formed in the panel 104 to help align the panel 104 in assembly. A ventilation system includes vents 110 and 112, which correlate to the thickness of attachment surfaces 100 of clips 84 and 86, wherein the vent 110 is disposed between panel 104 and the substrate 76 and vent 112 is disposed between panel 104 and exterior panel 70.

Figure 13:
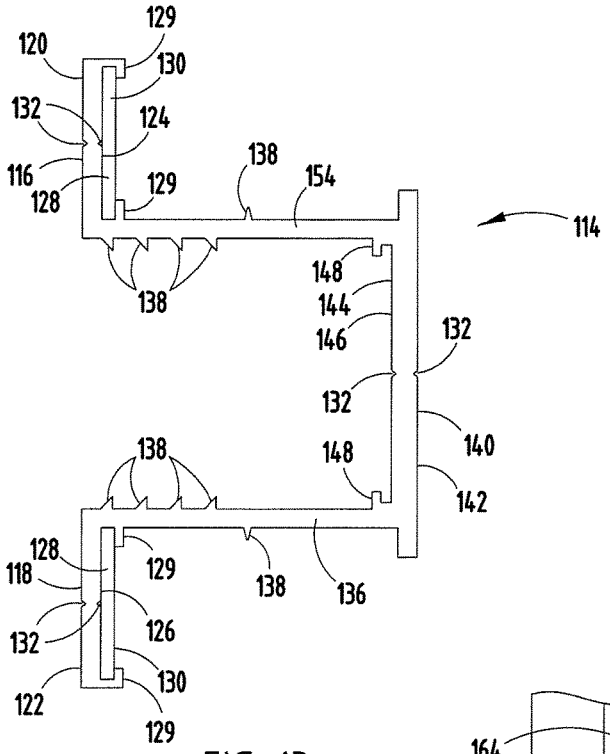
FIG. 13 is a side elevational view of a bracket system of another embodiment of the present invention.

In another embodiment of the present invention, a polymeric bracket member 114 is shown as a hat-shaped bracket member, or girt (FIG. 13). In this embodiment, the bracket member 114 comprises first and second bottom anchor flanges or sections 116 and 118 having exterior sides 120 and 122 respectively, and interior sides 124 and 126 respectively. T-shaped channels 128 are disposed on the interior sides 124, 126 of anchor flanges 116, 118, and the T-shaped channels 128 have channel tabs 129 which are used to positively capture an insert 130 in assembly. Fastener guide channels 132 are disposed on the exterior and interior sides 120, 122, 124, 126 of the bottom anchor flanges 116, 118 for use in guiding fasteners through a bracket member into a substrate. The bracket member 114 further comprises first and second webs or side walls 134, 136 which have insulation panel retention fins 138 disposed on either side of side walls 134, 136 to facilitate the retention of insulation panels in assembly. The bracket member 114 further comprises a top support section 140 which has an exterior side 142 and an interior side 144. Both the exterior side and the interior side have fastener guide channels 132 and the interior side 144 further comprises a T-shaped channel 146 having tabs 148 for positively capturing a variable gauge insert (not shown) in assembly.

Figure 13A:
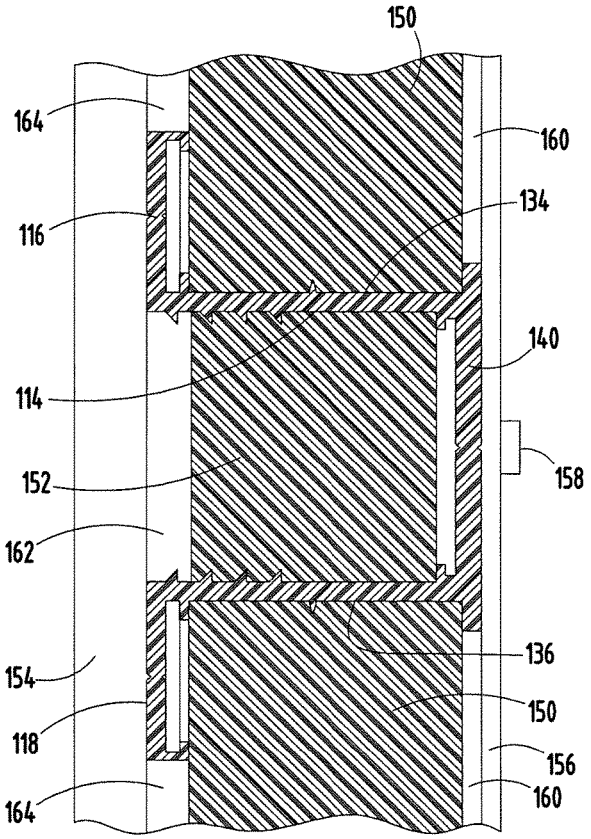
FIG. 13A is a fragmentary side elevational view of a bracket system attached to a substrate and exterior panel.

As shown in FIG. 13A, bracket member 114 is shown in a wall assembly wherein the bracket member 114 is attached to a building substrate 154 at bottom anchor flanges 116, 118. This attachment is made by fasteners known in the art (not shown). Panels 150 and 152 are shown in the assembly wherein panels 150 span between bracket member 114 and another like bracket member 114 (not shown). Panel 152 is disposed in a channel formed between side walls 134 and 136 of bracket member 114. An exterior panel 156 is attached to top support section 140 of bracket member 114 via fasteners 158. A ventilation system further includes vents 160, which are formed between panels 150 and exterior panels 156, for ventilation and rain sheeting of the system. Vents 164 are formed between the panels 150 and the building substrate 154 for cross-ventilation and moisture sheeting purposes and vent 162 is formed between panel 152 and the building substrate 154 for ventilation within the interior space of bracket member 114. In this configuration, bracket member 114, formed from a polymeric material having a high R-value, forms a thermal break between the exterior panel 156 and the building substrate 154. Further, in this configuration, there are no like materials in contact with another, nor is there any metal to metal contact creating a pathway for heat to transfer from the exterior to the interior and vice versa.

Figure 14:
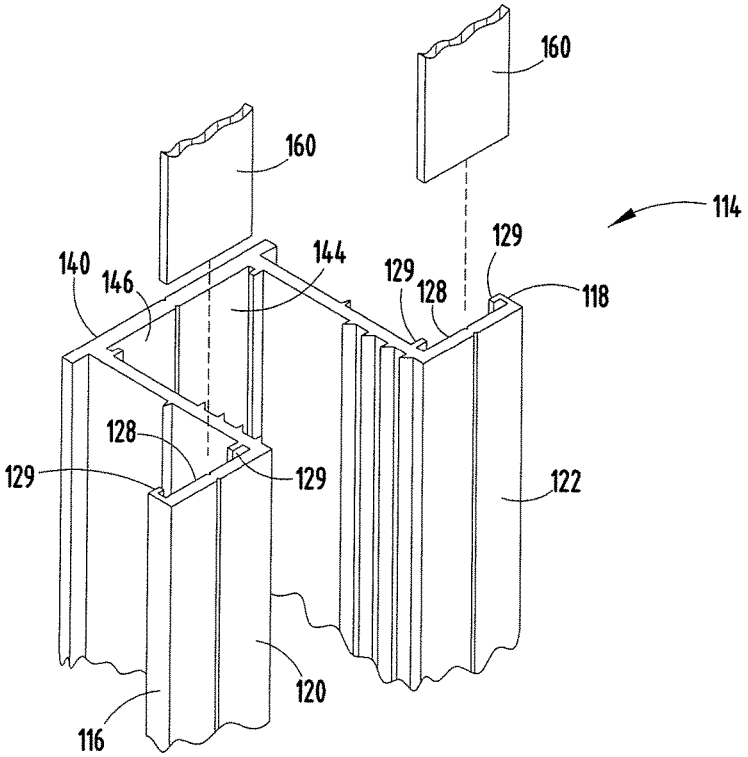
FIG. 14 is a fragmentary perspective view of a bracket member.
Figure 15:
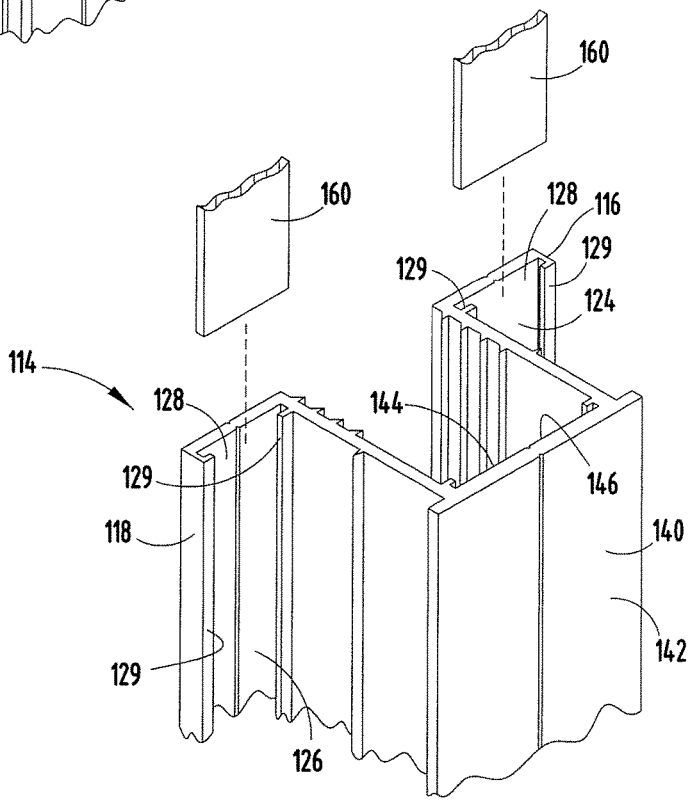
FIG. 15 is a fragmentary perspective view of a bracket member.

As shown in FIGS. 14 and 15, the bracket member 114 is shown with inserts 160 to be inserted in the T-shaped channels 128 disposed on the interior sides 124, 126 of the bottom anchor flanges 116, 118 where they will be held in place by channel tabs 129. The inserts 160 are made of a rigid material, such as a rigid polymer or metallic material and are slideable along the length of the T-shaped channels 128. Further, it is contemplated that a similar insert (not shown) can be inserted in the T-shaped channel 146 disposed on the interior side 144 of the top support 140 of bracket member 114. As with the bottom anchor flanges 116, 118, the top support 140 has channel tabs 148 disposed on the interior side 146 of the top support 140, which hold an insert (not shown) in place in assembly. An insert used in the T-shaped channel 146 is slideable along the length of the channel 146 to a desired location where fasteners (not shown) will be used to hold an exterior panel (not shown) in place on top support 140. The inserts 160, as well as the insert used in T-shaped channel 146, are used to retain the fasteners in place in assembly.

The above description is considered that of the preferred embodiments only. Modifications of the invention will occur to those skilled in the art and to those who make or use the invention. Therefore, it is understood that the embodiments shown in the drawings and described above are merely for illustrative purposes and not intended to limit the scope of the invention, which is defined by the following claims as interpreted according to the principals of patent law, including the Doctrine of Equivalents.

The invention claimed is:

1. A bracket member configured for use with an insulation system and configured for extending between a building substrate and an exterior cladding, with the bracket member coupling to thereto, the bracket member comprising:

an elongated body extending from a first side to a second side comprising:

a body wall, the body wall having a top surface and bottom surface, an inner end and an outer end, the body wall configured to be one of perpendicular and oblique to each of the building substrate and the exterior cladding, and to span therebetween;

a first end wall extending away from the inner end of the body wall, one of oblique and perpendicular to the top surface of the body wall, and having a distal end spaced apart from the top surface of the body wall, the first end wall having an outer surface structurally configured to overlie the building substrate;

a second end wall extending from the outer end of the body wall one of oblique and perpendicular to the top surface of the body wall, and having a distal end spaced apart from the top surface of the body wall, the first end wall having an outer surface structurally configured to overlie the exterior cladding;

wherein at least the body wall of the elongated body comprises a pultruded fiber reinforced polymer;

wherein at least a portion of each of the first end wall and the second end wall comprises an elongated metal member, and each of the first and second end wall further comprise a pultruded fiber reinforced polymer, wherein the elongated metal member of each of the first end wall and second end wall is slidably attachable in interlocking engagement to a portion of the first end wall and the second end wall that is formed from a fiber reinforced polymer, so that one of the elongated metal member and the fiber reinforced portion at least partially encases the other of the elongated metal member and the fiber reinforced portion in each of the first end wall and the second end wall, wherein the elongated metal member of each of the first end wall and the second end wall is structurally configured for receiving a fastener therethrough and into one of the respective building substrate and the exterior cladding.

2. The bracket member of claim 1 wherein at least one of the inner end and the outer end of the body wall defines a channel formed in the fiber reinforced polymer, with a corresponding one of the first end wall and the second end wall having an elongated metal channel configured to matingly engage with the channel of the body wall in slidable engagement.

3. The bracket member of claim 2 wherein each of the inner end and the outer end of the body wall define a channel, with each of the first end wall and the second end wall having an elongated metal channel configured to matingly engage with the channel of the body wall in slidable engagement.

4. The bracket member of claim 3 wherein the entirety of the first end wall and the entirety of the second end wall comprise an elongated metal member.

5. The bracket member of claim 4 wherein the profile of each of the body wall, the first end wall and the second end wall are substantially uniform along the length thereof.

6. The bracket member of claim 3 wherein the channel of the inner end of the body wall comprises a generally t-shaped channel, with the elongated metal channel of the first end wall comprising a generally u-shaped channel configured to matingly engage therewith.

7. The bracket member of claim 6 wherein the channel of the outer end of the body wall comprises a generally t-shaped channel, with the elongated metal channel of the second end wall comprising a generally u-shaped channel configured to matingly engage therewith.

8. The bracket member of claim 7 wherein the first end wall predominantly extends away from the top surface of the body wall, and the second end wall predominantly extends away from the bottom surface of the body wall.

9. The bracket member of claim 8 wherein the first end wall and the second end wall are substantially parallel to each other.

10. The bracket of claim 1 wherein one of the fiber reinforced polymer portions surround the elongated metal member or the elongated metal member surrounds a portion of the fiber reinforced polymer portions.

11. The bracket of claim 10 wherein the first end wall includes a channel, with the elongated metal member associated with the first end wall being positionable within the channel of the first end wall.

12. The bracket of claim 11 wherein the second end wall includes a channel, with the elongated metal member associated with the second end wall being positionable within the channel of the second end wall.

13. The bracket of claim 12 wherein the elongated metal member associated with the first end wall and the elongated metal member associated with the second end wall are slidably positionable relative to the respective one of the first end wall and the second end wall with which they are associated.

14. The bracket member of claim 1 wherein the elongated metal member associated with the first end wall and the elongated metal member associated with the second end wall are spaced apart maintained in a spaced apart orientation by way of the fiber reinforced polymer member.

* * * * *